US007358461B2

(12) United States Patent
Sone et al.

(10) Patent No.: US 7,358,461 B2
(45) Date of Patent: Apr. 15, 2008

(54) FUSER AND HEATFUSING CONTROL METHOD

(75) Inventors: Toshihiro Sone, Yokohama (JP); Osamu Takagi, Chofu (JP); Satoshi Kinouchi, Tokyo (JP); Yoshinori Tsueda, Fuji (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/318,496

(22) Filed: Dec. 28, 2005

(65) Prior Publication Data

US 2006/0131302 A1 Jun. 22, 2006

Related U.S. Application Data

(63) Continuation of application No. 10/805,305, filed on Mar. 22, 2004, now Pat. No. 7,002,118.

(51) Int. Cl.
*H05B 1/00* (2006.01)
*H05B 6/14* (2006.01)

(52) U.S. Cl. ..... 219/216; 219/619

(58) Field of Classification Search ..... 219/216, 219/619; 101/8; 347/171; 399/328; *H05B 1/00, H05B 6/14*

See application file for complete search history.

(56) References Cited

U.S. PATENT DOCUMENTS

| | | | |
|---|---|---|---|
| 6,026,273 | A | 2/2000 | Kinouchi et al. |
| 6,078,781 | A | 6/2000 | Takagi et al. |
| 6,087,641 | A | 7/2000 | Kinouchi et al. |
| 6,097,926 | A | 8/2000 | Takagi et al. |
| 6,137,985 | A | 10/2000 | Kinouchi et al. |
| 6,337,969 | B1 | 1/2002 | Takagi et al. |
| 6,415,128 | B1 | 7/2002 | Takagi et al. |
| 6,438,335 | B1 | 8/2002 | Kinouchi et al. |
| 6,643,476 | B1 | 11/2003 | Kinouchi et al. |
| 6,643,491 | B2 | 11/2003 | Kinouchi et al. |
| 6,650,854 | B2 | 11/2003 | Sone |
| 6,724,999 | B2 | 4/2004 | Kikuchi et al. |
| 6,725,000 | B2 | 4/2004 | Takagi et al. |

(Continued)

FOREIGN PATENT DOCUMENTS

| | | | |
|---|---|---|---|
| JP | 2001-235962 | A | 8/2001 |

(Continued)

OTHER PUBLICATIONS

U.S. Appl. No. 10/799,770, filed Mar. 15, 2004, Kikuchi et al.

(Continued)

*Primary Examiner*—Daniel Robinson
(74) *Attorney, Agent, or Firm*—Foley & Lardner LLP

(57) ABSTRACT

According to a mode of the present invention, there is disclosed a fixing apparatus comprising a non-contact temperature detection section which detects a temperature by infrared rays radiated from a heating member, to made uniform a surface temperature of the heating member in an axial direction and a rotation direction based on first temperature information for detecting a temperature difference of the axial direction of the heating member and second temperature information for detecting the temperature difference of the rotation direction of the heating member.

11 Claims, 5 Drawing Sheets

U.S. PATENT DOCUMENTS

| | | | | |
|---|---|---|---|---|
| 6,763,206 | B2 | 7/2004 | Kinouchi et al. | |
| 6,920,294 | B2 * | 7/2005 | Takano | 399/69 |
| 7,016,625 | B2 * | 3/2006 | Sekiguchi et al. | 399/92 |
| 7,082,272 | B2 * | 7/2006 | Takano | 399/69 |
| 2003/0219271 | A1 | 11/2003 | Kinouchi et al. | |
| 2004/0141038 | A1 | 7/2004 | Takagi et al. | |
| 2004/0173603 | A1 | 9/2004 | Kinouchi et al. | |
| 2004/0175211 | A1 | 9/2004 | Sone et al. | |
| 2004/0175212 | A1 | 9/2004 | Tsueda et al. | |
| 2004/0179874 | A1 | 9/2004 | Kinouchi et al. | |
| 2004/0184852 | A1 | 9/2004 | Takagi et al. | |
| 2004/0188421 | A1 | 9/2004 | Takagi et al. | |
| 2004/0188422 | A1 | 9/2004 | Wasai et al. | |
| 2004/0228646 | A1 * | 11/2004 | Sekiguchi et al. | 399/92 |
| 2004/0238531 | A1 | 12/2004 | Kikuchi et al. | |
| 2004/0265021 | A1 | 12/2004 | Kinouchi et al. | |
| 2005/0173417 | A1 * | 8/2005 | Takagi et al. | 219/619 |

FOREIGN PATENT DOCUMENTS

| | | | |
|---|---|---|---|
| JP | 2001-242743 | A | 9/2001 |

OTHER PUBLICATIONS

U.S. Appl. No. 10/805,522, filed Mar. 22, 2004, Kikuchi et al.
U.S. Appl. No. 10/805,514, filed Mar. 22, 2004, Kinouchi et al.
U.S. Appl. No. 10/805,308, filed Mar. 22, 2004, Tsueda et al.
U.S. Appl. No. 10/805,507, filed Mar. 22, 2004, Kikuchi et al.
U.S. Appl. No. 10/805,420, filed Mar. 22, 2004, Sone et al.
U.S. Appl. No. 10/820,138, filed Apr. 8, 2004, Sone et al.

* cited by examiner

FIG. 4

| | Comparison temperature | Difference temperature | Comparison result | ON coil | OFF coil |
|---|---|---|---|---|---|
| First IH control section | N1, N2 | H1 | N1 > N2 | 72 | 71 |
| | | | N1 < N2 | 71 | 72 |
| | N1, N3 | H2 | N1 > N3 | 73 | 71 |
| | | | N1 < N3 | 71 | 73 |

FIG. 5

| | Comparison temperature | Difference temperature | Comparison result | ON coil | OFF coil |
|---|---|---|---|---|---|
| First IH control section | N1, N4 | H3 | N1 > N4 | 72 | 71 |
| | | | N1 < N4 | 71 | 72 |
| | N1, N5 | H4 | N1 > N5 | 73 | 71 |
| | | | N1 < N5 | 71 | 73 |
| Second IH control section | N2, N4 | H5 | N2 > N4 | 71 | 72 |
| | | | N2 < N4 | 72 | 71 |
| Third IH control section | N3, N5 | H6 | N3 > N5 | 71 | 73 |
| | | | N3 < N5 | 73 | 71 |

FUSER AND HEATFUSING CONTROL METHOD

The present application is a continuation of U.S. application Ser. No. 10/805,305, filed Mar. 22, 2004, now U.S. Pat. No. 7,002,118 the entire contents of which are incorporated herein by reference.

BACKGROUND OF THE INVENTION

1. Field of the Invention

The present invention relates to a fixing apparatus which is mounted on an image forming apparatus to form an image on a transfer material using an electrophotographic process, a copying machine, a printer, or the like, and which fixes a developer on the transfer material onto the transfer material.

2. Description of the Related Art

It has been known that in a copying machine or a printer using an electrophotographic process, a toner image formed on a photosensitive drum is transferred onto a transfer material, and thereafter the toner image molten in a fixing apparatus including a heating roller and a pressurizing roller is fixed onto the transfer material.

In recent years, as a method of heating the heating roller, an example has been known in which a heat-resistant film material having a thin metal layer (conductive film) is formed in an endless belt form or a cylindrical shape (roller) and is brought into contact with a member to be fixed using induction heating. Accordingly, as compared with a heating method using a lamp or the like, response to a temperature change of the heating roller increases, temperature instantly rises, and warming-up time can be shortened.

Moreover, an example has been known in which a plurality of heating portions (coils) using the induction heating are arranged in a longitudinal direction of the heating roller to heat a predetermined region of the heating roller selected in accordance with a size or the like of a fixing sheet.

At this time, a method is known in which surface temperature is detected using a detection element brought into contact with the surface of the heating roller to control the temperature of the heating roller.

However, the response of temperature detection of the contact temperature detection element is lower than that (heating response) to a temperature rise of the heating roller heated by the induction heating, and a time lag sometimes occurs. There is a problem that the temperature of the heating roller rises above a fixing temperature and overshoot occurs.

Moreover, there is a problem that a correct temperature of the heating roller cannot be detected by a shift between the response of the detection of the contact temperature detection element and the heating response of the heating roller. Accordingly, when a plurality of coils are arranged in the longitudinal direction of the heating roller, there is a problem that a temperature unevenness is caused in a predetermined region of the heating roller heated by the different coils. This temperature unevenness causes a high-temperature offset or a low-temperature offset in the longitudinal direction of the heating roller, and causes a problem that a defect is caused in the image on the fixing sheet in a main scanning line direction.

BRIEF SUMMARY OF THE INVENTION

According to an aspect of the present invention, there is provided a fixing apparatus comprising:

a heating member which supplies heat to a sheet;

a pressurizing member which contacts the heating member and which has a predetermined pressure in a contact position;

a heating device including a plurality of heating members which heat the heating member;

a non-contact temperature detection mechanism including a plurality of non-contact temperature detection sections disposed in non-contact with the surfaces of the heating members to obtain first temperature information for detection of a temperature difference of an axial direction of the heating members, and second temperature information for detection of a temperature difference of a rotation direction of the heating members; and a control mechanism which controls a power value supplied to the heating member based on at least one of the first and second temperature information.

According to another aspect of the present invention, there is provided a fixing apparatus comprising:

a heating member which supplies heat to a sheet;

a pressurizing member which contacts the heating member and which has a predetermined pressure in a contact position;

a heating device including a plurality of heating members which heat the heating member, and a control section which independently drives the heating members;

a non-contact temperature detection mechanism including a plurality of non-contact temperature detection elements disposed in non-contact with the surfaces of the heating members to detect temperatures of at least detection places whose number is not less than that of the plurality of heating members; and a control mechanism which controls a power value supplied to the heating member based on temperature information corresponding to the plurality of detection places from the non-contact temperature detection mechanism.

According to further another aspect of the present invention, there is provided a heatfusing control method comprising:

heating an outer peripheral surface of a heating member using a plurality of induction heating coils arranged outside the heating member;

detecting first temperature information for detection of a temperature difference of an axial direction of the heating member and second temperature information for detection of a temperature difference of a rotation direction of the heating member using at least two non-contact temperature detection elements disposed for each induction heating coil or between the coils; and executing at least one of an axial direction temperature control to minimize the temperature difference of the axial direction of the heating member and a rotation direction temperature control to minimize the temperature difference of the rotation direction of the heating member based on the first and second temperature information.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 4 is a reference diagram showing an example of a coil center mode in a heatfusing control method applicable to the fixing apparatus of the present invention;

FIG. 5 is a reference diagram showing an example of a coil joint mode in the heatfusing control method applicable to the fixing apparatus of the present invention;

DETAILED DESCRIPTION OF THE INVENTION

An example of a fixing apparatus to which an embodiment of the present invention is applied will be described hereinafter with reference to drawings.

Figure 1:
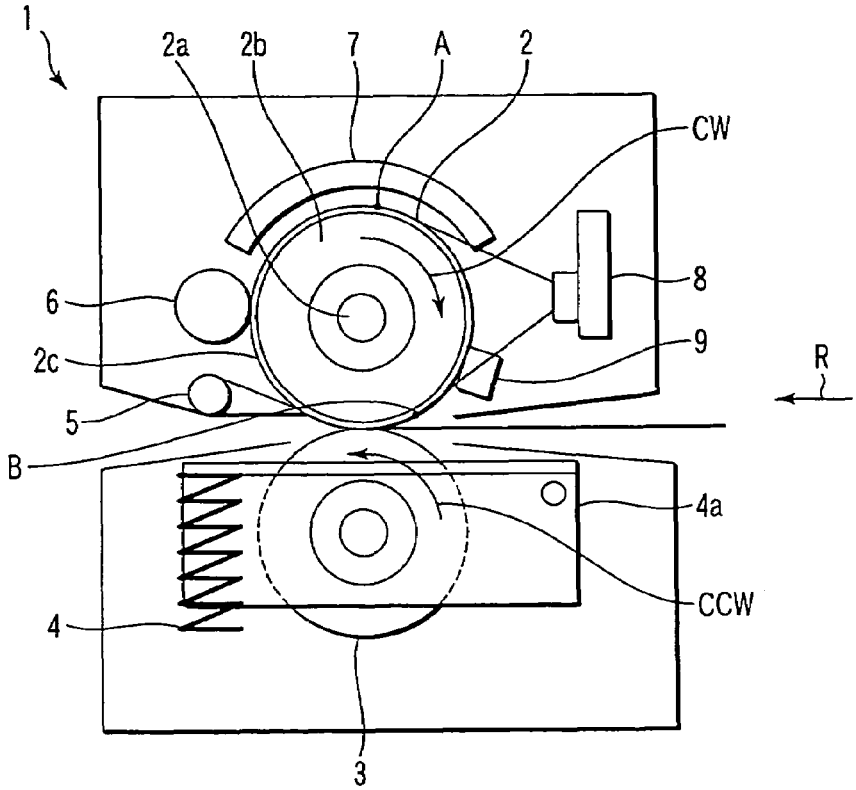
FIG. 1 is a schematic diagram showing an example of a fixing apparatus to which an embodiment of the present invention is applicable.

FIG. 1 shows an example of the fixing apparatus to which the embodiment of the present invention is applied.

As shown in FIG. 1, a fixing apparatus 1 includes a heating member (heating roller) 2, a pressurizing member (pressurizing roller) 3, a pressurizing spring 4, a peeling claw 5, a cleaning roller 6, an induction heating device 7, a temperature detection mechanism 8, and a thermostat 9.

The heating roller 2 includes a shaft 2*a* formed of a material having rigidity (hardness) which is not deformed at a predetermined pressure, an elastic layer (foam rubber layer, sponge layer, silicone rubber layer) 2*b* arranged around the shaft 2*a* in order, and a metal member (metal conductive layer) 2*c*. It is to be noted that in the present embodiment a solid rubber layer and a mold releasing layer formed of thin film layers such as a silicone rubber are preferably formed outside the metal conductive layer 2*c*.

The metal conductive layer 2*c* is formed of conductive materials (such as nickel, stainless steel, aluminum, copper, and a composite material of stainless steel and aluminum). A length of the heating roller 2 in a longitudinal direction is preferably 330 mm.

It is to be noted that the foam rubber layer 2*b* is preferably formed in a thickness of 5 to 10 mm, the metal conductive layer 2*c* is formed in a thickness of 10 to 100 μm, and the solid rubber layer is formed in a thickness of 100 to 200 μm. In the present embodiment, the foam rubber layer 2*b* is formed in a thickness of 5 mm, the metal conductive layer 2*c* is formed in 40 μm, the solid rubber layer is formed in 200 μm, and the mold releasing layer is formed in 30 μm, and the heating roller 2 has a diameter of 40 mm.

The pressurizing roller 3 may also be an elastic roller including a periphery of a rotation shaft having a predetermined diameter, coated with a silicone rubber or a fluorine rubber having a predetermined thickness, or may also be a roller having the metal conductive layer and the elastic layer in the same manner as in the heating roller 2.

The pressurizing spring 4 is pressure welded with respect to an axial line of the heating roller 2 with a predetermined pressure, and the pressurizing roller 3 is maintained substantially parallel to the axial line of the heating roller 2. It is to be noted that predetermined pressures are supplied to the pressurizing spring 4 from opposite ends of the pressurizing roller 3 via a pressurizing support bracket 4*a* which supports the shaft of the pressurizing roller 3, and the spring can be parallel to the heating roller 2.

Accordingly, a nip having a predetermined width is formed between the heating roller 2 and the pressurizing roller 3.

The heating roller 2 is rotated in a direction of an arrow CW at a substantially constant speed by a fuser motor 28 described later with reference to FIG. 2. The pressurizing roller 3 contacts the heating roller 2 with a predetermined pressure by the pressurizing spring 4, the heating roller 2 is rotated, and accordingly the pressurizing roller is rotated in a direction opposite to a direction in which the heating roller 2 is rotated in a position wherein the pressurizing roller contacts the heating roller 2.

The peeling claw 5 is positioned in a predetermined position in the vicinity of the nip on a periphery of the heating roller 2 on a downstream side of a direction in which the heating roller 2 is rotated by the nip of the heating roller 2 contacting the pressurizing roller 3 to peel a sheet P passed through the nip from the heating roller 2. It is to be noted that the present invention is not limited to the present embodiment. For example, the sheet does not easily peel from the heating roller in a case where an amount of a developer to be fixed to the sheet is large, for example, as in color image formation. Therefore, a plurality of peeling claws 5 may also be disposed. The claw does not have to be disposed in a case where the sheet easily peels from the heating roller.

The cleaning roller 6 removes dust such as toner and paper waste offset on the surface of the heating roller 2.

The induction heating device 7 is disposed outside the heating roller 2, and has at least two coils for heating (excitation coils) to which predetermined power is supplied to supply a predetermined magnetic field to the heating roller 2. Predetermined power is supplied to each coil for heating from an excitation circuit 25 to heat the heating roller 2 at a predetermined temperature.

The temperature detection mechanism 8 is disposed in non-contact with the surface of the heating roller 2 to detect temperatures of a plurality of places of an outer peripheral surface of the heating roller 2. This will be described in detail. The temperature detection mechanism 8 is capable of detecting the temperatures in a first detection position A which is a portion at a high temperature in the outer peripheral surface of the heating roller 2 and a second detection position B on the downstream side of the rotation direction of the heating roller 2 of the first detection position A and immediately before the nip portion in order to detect a temperature difference of the heating roller 2 in the rotation direction.

The first detection position A is preferably a region facing the excitation coil of the induction heating device 7 in the outer peripheral surface of the heating roller 2, but may also be, for example, immediately after an outlet of the induction heating device 7 in the rotation direction of the heating roller 2.

That is, the second detection position B is a detection place different from the first detection position A in phase in the rotation direction of the heating roller. In the second detection position, a temperature of the first detection position A several seconds after is detected, and the temperature of the heating roller 2 immediately before the use in a fixing operation can be detected.

The thermostat 9 detects a heating abnormality in which the surface temperature of the heating roller 2 abnormally rises, and is used for interrupting a power supplied to the coil for heating of the induction heating device 7 in a case where the heating abnormality occurs. It is to be noted that at least one or more thermostats 9 are preferably disposed in the vicinity of the surface of the heating roller 2.

Moreover, the peeling claw for peeling the sheet P from the pressurizing roller 3, and a cleaning roller for removing toner attached to the peripheral surface of the pressurizing roller 3 may also be disposed on the periphery of the pressurizing roller 3.

The sheet P holding toner T is passed through the nip portion formed between the heating roller 2 and the pressurizing roller 3, and the molten toner T is pressure-attached to the sheet P to fix the image.

Figure 2:
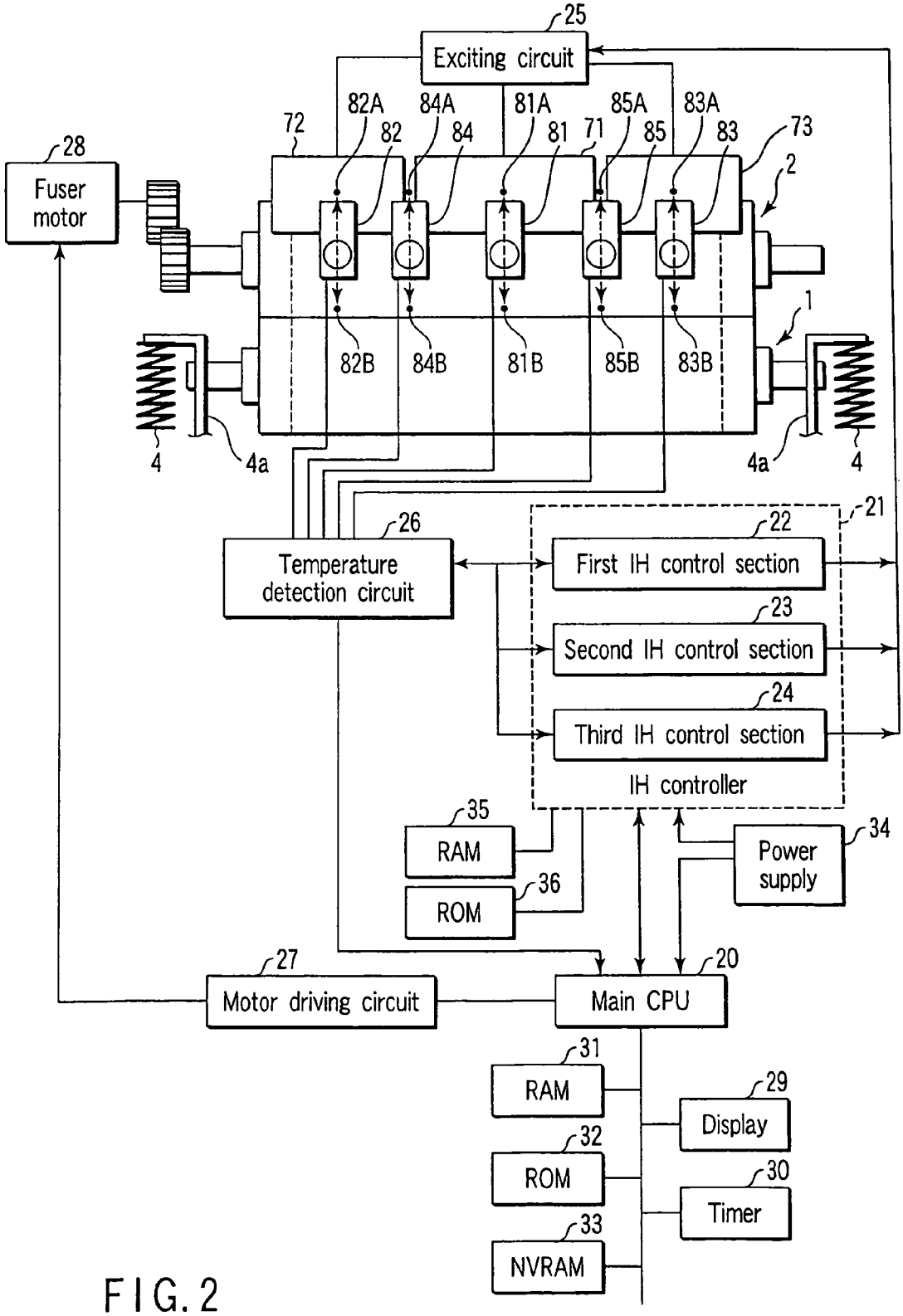
FIG. 2 is a block diagram showing a control system of the fixing apparatus shown in FIG. 1.

FIG. 2 shows a block diagram showing a control system of the fixing apparatus shown in FIG. 1. Moreover, a schematic diagram of the fixing apparatus shown in FIG. 1 as viewed from an arrow R side is also shown.

As shown in FIG. 2, the induction heating device 7 includes coils for induction heating 71, 72, 73. The coil 71 is disposed facing a middle portion of the heating roller 2 in the axial direction to supply a magnetic field to the middle portion of the heating roller 2, and the coils 72, 73 are disposed in end portions of the heating roller 2 in the axial direction and facing each other to supply the magnetic field to the end portions of the heating roller 2.

The temperature detection mechanism 8 includes, for example, a plurality of non-contact temperature detection elements 81, 82, 83, 84, 85 arranged in the longitudinal direction of the heating roller 2. The non-contact temperature detection elements 81, 82, 83, 84, 85 are capable of detecting temperatures of two or more places with one element, and a thermopile which generates an electromotive force, for example, by the Seebeck effect, an infrared sensor which detects a temperature change by the pyroelectric effect, and the like are usable.

The non-contact temperature detection element 81 detects the temperatures of a first detection position 81A on the surface of the heating roller 2 facing the coil 71, and a second detection position 81B positioned immediately before the nip on the downstream side of the first detection position 81A in the rotation direction of the heating roller 2. The non-contact temperature detection element 82 detects the temperatures of a first detection position 82A on the surface of the heating roller 2 facing the coil 72, and a second detection position 82B positioned immediately before the nip on the downstream side of the first detection position 82A in the rotation direction of the heating roller 2. The non-contact temperature detection element 83 detects the temperatures of a first detection position 83A on the surface of the heating roller 2 facing the coil 73, and a second detection position 83B positioned immediately before the nip on the downstream side of the first detection position 83A in the rotation direction of the heating roller 2.

The non-contact temperature detection element 84 detects the temperatures of a first detection position 84A on the surface of the heating roller 2 facing a joint between the coils 71 and 72, and a second detection position 84B positioned immediately before the nip on the downstream side of the first detection position 84A in the rotation direction of the heating roller 2. The non-contact temperature detection element 85 detects the temperatures of a first detection position 85A on the surface of the heating roller 2 facing a joint between the coils 71 and 73, and a second detection position 85B positioned immediately before the nip on the downstream side of the first detection position 85A in the rotation direction of the heating roller 2.

In this manner, the temperature detection mechanism 8 detects the temperatures of the first detection positions 81A to 85A to detect the temperature difference of the heating roller 2 in the axial direction, and detects the temperatures of the second detection positions 81B to 85B facing the first detection positions 81A to 85A to detect the temperature difference of the heating roller 2 in the rotation direction.

It is to be noted that in the present embodiment, an example in which in the temperature detection mechanism 8, five non-contact temperature detection elements capable of detecting the temperatures of two or more places with one element are disposed in the axial direction of the heating roller 2 has been described. However, the present invention is not limited to this embodiment, and for example, detection elements disposed in accordance with the detection places may also be used.

With the use of the non-contact temperature detection element as in the present embodiment, the elements are preferably disposed in the middle of each coil disposed in the induction heating device 7, and in the position facing each joint between the coils. Assuming that the number of coils disposed in the induction heating device 7 is CX and the number of non-contact temperature detection elements disposed in the temperature detection mechanism 8 is SY, $CX \leqq SY \leqq 2CX-1$ is preferable.

Moreover, as shown in FIG. 2, a main CPU 20 is connected to an IH controller 21, the excitation circuit 25. a temperature detection circuit 26, a motor driving circuit 27, the fuser motor 28, a display section 29, a timer 30, a RAM 31, a ROM 32, an NVRAM 33, and a power supply 34.

The main CPU 20 generally controls a fixing operation of the fixing apparatus 1.

The IH controller 21 includes first, second, and third IH control sections 22, 23, 24, and outputs a driving signal to set the surface of the heating roller at a predetermined temperature based on the temperature information input from the temperature detection circuit 26 to the excitation circuit 25 to supply predetermined power to the coils 71, 72, 73. That is, the IH controller 21 includes the first, second, and third IH control sections 22, 23, 24 capable of supplying power independently to the coils 71, 72, 73.

The temperature information detected by at least the non-contact temperature detection elements 81, 84, 85 is input into the first IH control section 22 via the temperature detection circuit 26 to output a driving signal for supplying predetermined power to the coil 71 to the excitation circuit 25.

The temperature information detected by at least the non-contact temperature detection elements 82, 84 is input into the second IH control section 23 via the temperature detection circuit 26 to output a driving signal SG2 for supplying predetermined power to the coil 72 to the excitation circuit 25.

The temperature information detected by at least the non-contact temperature detection elements 83, 85 is input into the third IH control section 24 via the temperature detection circuit 26 to output a driving signal SG3 for supplying predetermined power to the coil 73 to the excitation circuit 25.

It is to be noted that the first IH control section 22 is capable of outputting the driving signals SG2, SG3 in accordance with an executed temperature control (described later).

That is, the first, second, and third IH control sections 22, 23, 24 of the IH controller 21 are capable of supplying predetermined power based on the temperature information of the heating roller 2 output from the temperature detection circuit 26 so that the temperature of the heating roller 2 is a fixing temperature T1 required for fusing.

The excitation circuit 25 supplies predetermined power to the coils 71 to 73 in response to excitation signals SG1 to SG3 output from the first, second, and third IH control sections 22, 23, 24 of the IH controller 21, respectively. This will be described in detail. When the IH controller 21 outputs the driving signal SG1 having a driving frequency, the excitation circuit 25 outputs power having a predetermined magnitude in accordance with the driving frequency to the coil 71. When the driving signal SG2 is output, power having the predetermined magnitude in accordance with the driving frequency is output to the coil 72. When the driving signal SG3 is output, power having the predetermined magnitude in accordance with the driving frequency is output to the coil 73.

Accordingly, the respective coils 71 to 73 produce a magnetic flux which is a predetermined heating force. The heating force has a magnitude of the magnetic flux constituting a factor for producing an eddy current in the heating roller 2, and is determined by the magnitudes of the power supplied to the respective coils 71 to 73. For example, when the sheet passes through the middle portion of the heating roller 2, predetermined power for exciting the coil 71 is output. When the sheet passes through the middle portion and end portions of the heating roller 2, predetermined respective power for exciting the coils 71 to 73 is output.

The temperature detection circuit 26 is connected to the non-contact temperature detection elements 81 to 85 to output the detected temperature information of the heating roller 2 to the IH controller 21.

It is to be noted that in the present embodiment, it is assumed in the following description that the temperature information of the first detection position 81A detected by the non-contact temperature detection element 81 is first temperature information N1 and the temperature information of the second detection position 81B is second temperature information M1. It is to be noted that the temperature detection circuit 26 is capable of outputting first temperature information N2 to N5 which are temperature information of the first detection positions 82A to 85A from the other non-contact temperature detection elements 82 to 85 and outputting second temperature information M2 to M5 which are temperature information of the second detection positions 82B to 85B.

The motor driving circuit 27 is connected to the fixing apparatus motor 28 which rotates the heating roller 2.

The display section 29 displays a serviceman inspection mode, and informs the cleaning/changing of the heating roller 2, or the cleaning of the temperature detection mechanism 8.

The timer 30 detects a time elapsed from when the power supply was turned ON. For example, a warming-up time W/UT required for the warming-up can be detected.

The RAM 31 temporarily holds predetermined information detected by the timer 30. The ROM 32 stores, for example, initial program or fixed data beforehand. The NVRAM 33 holds the stored information even when the power supply of the device is turned OFF.

Moreover, the IH controller 21 is connected to a RAM 35 and a ROM 36. The RAM 35 temporarily holds information such as difference temperature information G1, H1. The ROM 36 stores tables TB1 to 4.

Next, the temperature control of the IH controller 21 will be described.

The first, second, and third IH control sections 22, 23, 24 refer to the tables TB1 to TB4 to execute the temperature control capable of minimizing a temperature difference in the axial direction and rotation direction of the heating roller 2 based on the detected temperature information from the temperature detection mechanism 8.

The first, second, and third IH control sections 22, 23, 24 execute: (1) a warming-up control for allowing the surface temperature of the heating roller 2 to quickly rise to a set temperature T1 for the fixing at a warming-up time; (2) a rotation direction temperature control for minimizing the temperature difference of the heating roller 2 in the rotation direction; and (3) an axial direction temperature control for minimizing the temperature difference of the heating roller 2 in the axial direction.

(1) The warming-up control is executed based on the temperatures information from the non-contact temperature detection elements 81 to 83 which detect the temperature of the surface of the heating roller 2 facing the coils 71 to 73.

For example, the first IH control section 22 outputs the magnitude of the power to be output to a coil 7A defined in the table TB1, that is, a driving frequency F1 which is the driving signal SG1 to the excitation circuit 25 based on the temperature information (first temperature information N1) of the first detection position 81A detected by the non-contact temperature detection element 81.

Similarly, the second IH control section 23 outputs the driving frequency F1 which is the driving signal SG2 to the excitation circuit 25 based on the first temperature information N2 of the first detection position 82A. The third IH control section 24 outputs the driving frequency F1 which is the driving signal SG3 to the excitation circuit 25 based on the first temperature information N3 of the first detection position 83A.

Figure 3:
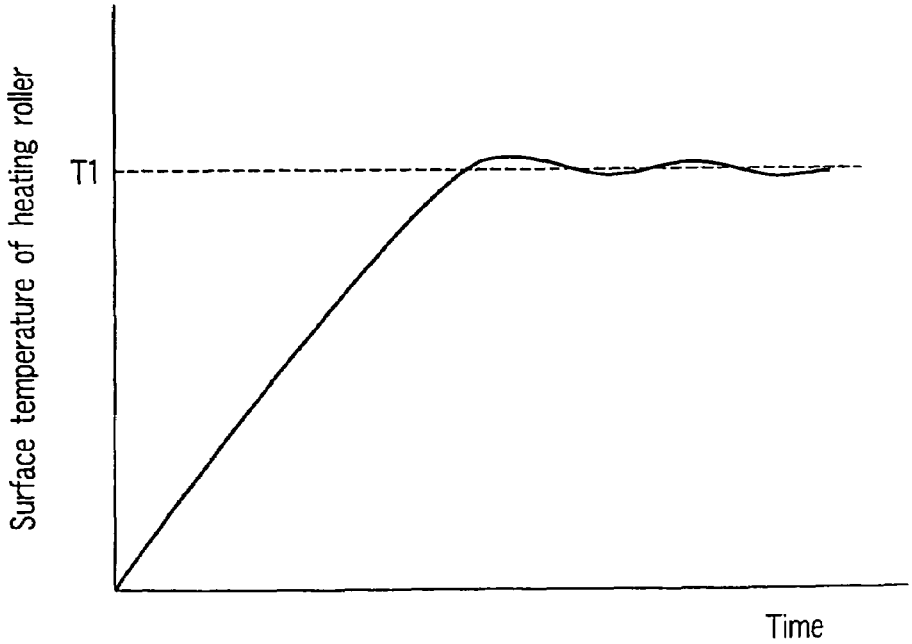
FIG. 3 is a reference diagram showing a warming-up correction applicable to the fixing apparatus of the present invention.

This will be described in detail. In the table TB1, to maintain the surface temperature of the heating roller 2 at the fixing temperature T1 as shown in FIG. 3, the surface temperature of the heating roller 2, that is, the driving frequency F1 determined based on the temperature information from the temperature detection mechanism 8 is defined. The driving frequency F1 decreases, when the surface temperature of the heating roller 2 approaches T1.

Moreover, the table TB1 also includes judgment information for stopping the power supplied to the coils 71 to 73, when the surface temperature of the heating roller 2 is excessively higher than T1. That is, the IH controller 21 stops an oscillation circuit in the excitation circuit 25, or does not output any driving signal to the excitation circuit 25, so that the powers supplied to the respective coils 71 to 73 can be stopped.

(2) The rotation direction temperature control is executed based on the first temperature information N1 to N5 detected in the first detection positions 81A to 85A which are high-temperature portions in the outer peripheral surface of the heating roller 2, second temperature information M1 to M5 detected in the second detection positions 81B to 85B immediately before the nip portion, and difference temperature information G1 to G5.

For example, the first IH control section 22 calculates the difference temperature information G1 between the first temperature information N1 and the second temperature information M1 of the first detection position 81A detected by the non-contact temperature detection element 81 to compare a first difference range GA with a second difference range GB.

This will be described in detail. When the difference temperature information GC is not less than the first difference range GA, the cleaning/changing of the non-contact temperature detection element 81 or the heating roller 2 is displayed in the display section 29. When the difference temperature information GC is within the second difference range GB, it is judged that the temperature difference of the rotation direction is infinitesimal and the heating roller 2 has a uniform temperature in the rotation direction. Furthermore, when the difference temperature information G1 is smaller than the first difference range GA and larger than the second difference range GB, it is judged that there is a temperature difference in the rotation direction.

The first IH control section 22 stops the power supplied to the coil 71 in a case where the difference temperature information G1 is not less than the first difference range GA, and outputs a defined predetermined driving frequency F2 to the excitation circuit 25 in a case where the information is smaller than the first difference range GA and larger than the second difference range GB. It is to be noted that the driving frequency F2 is defined in the table TB2 in accordance with the value of the difference temperature information G1.

It is to be noted that the difference temperature information G2 to G5 between first temperature information N1 to N5 and the second temperature information M1 to M5 in the other non-contact temperature detection elements 82 to 85 are also compared with the first and second difference ranges GA, GB to perform a rotation direction temperature control.

Moreover, the first IH control section 22 calculates the difference temperature information G4, G5 based on the non-contact temperature detection elements 84, 85, which are temperature information in the end portions of the coil 71, and compares the information with the first and second difference ranges GA, GB. It is to be noted that the first IH control section 22 is capable of outputting the driving signals SG1, SG2 based on the comparison result based on the difference temperature information G4 and is capable of outputting the driving signals SG1, SG3 in accordance with the comparison result based on the difference temperature information G5.

Similarly, the second IH control section 23 calculates the difference temperature information G2, and compares the difference temperature information G2 with the first and second difference ranges GA, GB, and is capable of outputting the driving signal SG2 to the excitation circuit 25. The third IH control section 24 calculates the difference temperature information G3, and compares the difference temperature information G3 with the first and second difference ranges GA, GB, and is capable of outputting the driving signal SG3 to the excitation circuit 25.

Moreover, the rotation direction temperature control may also be executed based on only the difference temperature information G1 to G3.

The (3) axial direction temperature control includes (31) a first axial direction temperature control and (32) a second axial direction temperature control.

(31) In the first axial direction temperature control, the table TB1 used in the above-described warming-up control is used, and the temperature of the heating roller 2 is maintained at the fixing temperature T1 based on the first temperature information from the non-contact temperature detection elements 81 to 83 which detect the temperature of the surface of the heating roller 2 for each of the coils 71 to 73.

(32) In the second axial direction temperature control, a temperature difference between a region (middle) through which the fixing sheet has passed and a region (end portion) through which any sheet does not pass is minimized during the passing of the fixing sheet having a predetermined size by the fixing operation.

Furthermore, the second axial direction temperature control includes a (321) coil center mode and a (322) coil joint mode in order to minimize the temperature difference between the adjacent coils.

FIG. 4 is a reference diagram showing this coil center mode.

In the (321) coil center mode, a table TB3 in which a driving frequency F3 defined in accordance with the value of difference temperature information H1 (H2) is set based on the detected information of the surface temperature of the heating roller 2 facing the middle portion of the coil is used, and the temperature control between the adjacent coils is executed. That is, the coil center mode is controlled based on the first temperature information N1 to N3 from the non-contact temperature detection elements 81 to 83 which detect the temperature of the surface of the heating roller 2 facing the coils 71 to 73.

For example, the first IH control section 22 calculates the difference temperature information H1 between the first temperature information N1 detected in the first detection position 81A and the first temperature information N2 detected in the first detection position 82A, refers to the table TB3, and outputs the driving frequency F3 in accordance with the value of the difference temperature information Hi. That is, the first IH control section 22 compares the first temperature information N1 with N2, stops the power supplied to the coil facing the detection place at a higher temperature, and supplies power to the coil facing the detection place at a lower temperature based on the driving frequency F3 of the table TB3.

Therefore, when the first temperature information N1>N2, the first IH control section 22 stops the power supplied to the coil 71, outputs the driving frequency F3 for driving an oscillation circuit facing the coil 72, and supplies power to the coil 72. Conversely, when the first temperature information N1<N2, the power supplied to the coil 72 is stopped, the driving frequency F3 is output to drive the oscillation circuit facing the coil 71, and power is supplied to the coil 71.

Similarly, the first IH control section 22 calculates the difference temperature information H2 between the first temperature information N1, N3, refers to the table TB3, and outputs the driving frequency F3 in accordance with the value of the difference temperature information H2. Since the subsequent control is the same as that based on the above-described difference temperature information H1, the description is omitted with reference to FIG. 4.

FIG. 5 is a reference diagram showing the coil joint mode.

In the (322) coil joint mode, a table TB4 in which a driving frequency F4 defined in accordance with the value of difference temperature information H3 (including H4 to H6 described later) is set based on the detected information of the surface temperature of the heating roller 2 facing the joint between the coils is used, and the temperature control between the adjacent coils is executed. That is, the coil joint mode is controlled based on the first temperature information N1 to N5 from the non-contact temperature detection elements 81 to 85.

For example, the first IH control section 22 calculates the difference temperature information H3 between the first temperature information N1 detected in the first detection position 81A with the first temperature information N4 detected in the first detection position 84A, refers to the table TB4, and outputs the driving frequency F4 in accordance with the value of the difference temperature information H3.

That is, the first IH control section 22 stops the power supplied to the coil facing the detection place at a higher temperature, and supplies power based on the table TB4 to the coil facing the detection place at a lower temperature in the first temperature information N1, N4.

Therefore, when the first temperature information N1>N4, the first IH control section 22 stops the power supplied to the coil 71, outputs the driving frequency F4 for driving the oscillation circuit facing the coil 72, and supplies power to the coil 72. Conversely, when N1<N4, the power supplied to the coil 72 is stopped, the driving frequency F4 is output to drive the oscillation circuit facing the coil 71, and power is supplied to the coil 71.

Similarly, the first IH control section 22 calculates the difference temperature information H4 between the first temperature information N1, N5, refers to the table TB4, and outputs the driving frequency F4 in accordance with the value of the difference temperature information H4. Since the subsequent control is the same as that based on the above-described difference temperature information H3, the description is omitted with reference to FIG. 5.

Moreover, similarly, the second IH control section 23 calculates the difference temperature information H5 between the first temperature information N2, N4, refers to the table TB4, and outputs the driving frequency F4 in accordance with the value of the difference temperature information H5. Since the subsequent control is the same as that based on the above-described difference temperature information H3, the description is omitted with reference to FIG. 5.

Furthermore, similarly, the third IH control section 24 calculates the difference temperature information H6 between the first temperature information N3, N5, refers to the table TB4, and outputs the driving frequency F4 in accordance with the value of the difference temperature information H6. Since the subsequent control is the same as that based on the above-described difference temperature information H3, the description is omitted with reference to FIG. 5.

Next, a heatfusing control method incorporated in the fixing apparatus of the present invention will be described.

Figure 6:
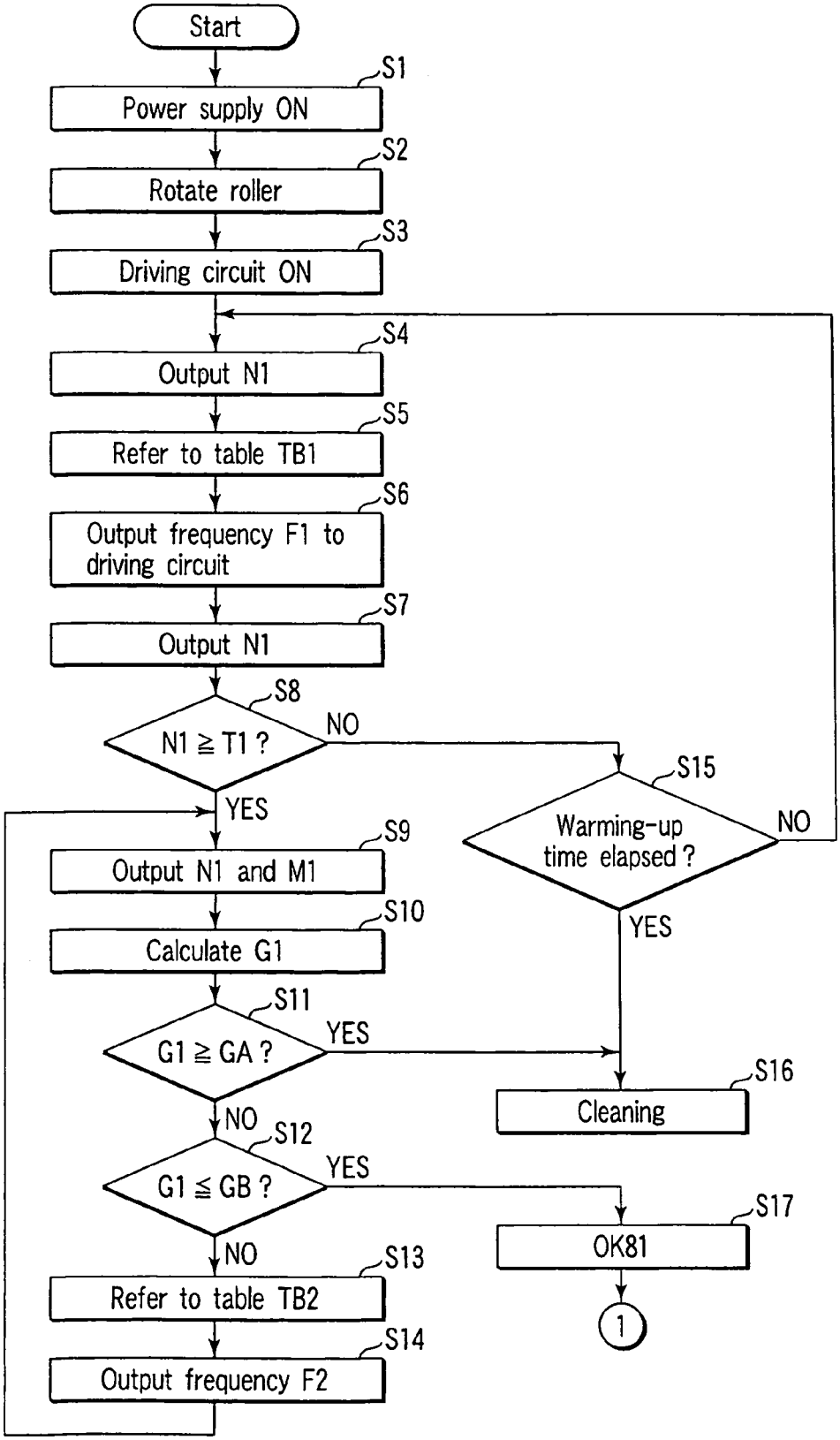
FIG. 6 is a flowchart showing an example of an operation of the fixing apparatus shown in FIG. 1.

FIG. 6 shows an example of a heating control method of the coil 71 for heating the middle portion of the heating roller in the axial direction in the induction heating device 7.

As shown in FIG. 6, when the power supply of the fixing apparatus is turned ON (S1), the heating roller 2 and the pressurizing roller 3 are rotated (S2), and the first IH control section 22 outputs the driving signal SG1 for the coil 71 to the excitation circuit 25 (S3).

The non-contact temperature detection element 81 outputs the first temperature information N1 detected in the first temperature detection position 81A to the IH controller 21 via the temperature detection circuit 26 (S4).

The first IH control section 22 of the IH controller 21 executes the above-described warming-up control based on the first temperature information N1. That is, the first IH control section 22 refers to the table TB1 (S5), and outputs the driving frequency F1 based on the first temperature information N1 as the driving signal SG1 of the coil 71 to the excitation circuit 25 (S6).

The non-contact temperature detection element 81 outputs the first temperature information N1 to the IH controller 21 via the temperature detection circuit 26 again (S7). The first IH control section 22 of the IH controller 21 judges whether or not the first temperature information N1 has reached the fixing temperature T1 (S8). If the first temperature information N1 is not less than the fixing temperature T1 (YES in S8), the above-described rotation direction temperature control is executed.

That is, the non-contact temperature detection element 81 outputs the first temperature information N1 detected in the first detection position 81A and the second temperature information M1 detected in the second temperature detection position to the IH controller 21 via the temperature detection circuit 26 (S9). The first IH control section 22 of the IH controller 21 calculates the difference temperature information G1 based on the first temperature information N1 and second temperature information M1 (S10).

The first IH control section 22 compares the calculated difference temperature information G1 with the first difference range GA (S11). When the difference temperature information G1 is smaller than the first difference range GA (NO in S11), the difference temperature information G1 is further compared with the second difference range GB (S12).

If the difference temperature information G1 is larger than the second difference range GB (NO in S12), the first IH control section 22 refers to the table TB2 (S13), outputs the driving frequency F2 based on the difference temperature information G1 as the driving signal SG1 of the coil 71 to the excitation circuit 25 (S14), and returns to step S9.

On the other hand, if the first temperature information N1 detected from the non-contact temperature detection element 81 has not reaches the fixing temperature T1 in step S8 (NO in S8), it is judged whether or not the warming-up time W/UT has elapsed (S15). If the warming-up time W/UT has not elapsed (NO in S15), the first IH control section 22 returns to step S4 to execute the warming-up control again. If the warming-up time W/UT elapses (YES in S15), or if the difference temperature information G1 is not less than the first difference range GA in step S11 (YES in S11), the IH controller 21 stops all power supplied to the coils 71 to 73, and displays a serviceman inspection mode in the display section 29 to inform that it is a time to clean/change the temperature detection mechanism 8 or the heating roller 2 (S16).

Moreover, when the difference temperature information G1 is not more than the second difference range GB in step S12 (YES in S12), it is judged that the temperature difference of the rotation direction is infinitesimal and the heating roller 2 has a uniform temperature in the rotation direction, and a pass signal OK81 is output (S17).

It is to be noted that in the present embodiment, the first temperature information N1 and second temperature information M1 detected by the non-contact temperature detection element 81 have been described. In the present invention, in step S3, at the same time the driving signal SG1 for the coil 71 is output to the excitation circuit 25, the driving signals SG2, SG3 for the coils 72, 73 are also output to the excitation circuit 25.

In the same manner as in steps S4 to S8, the non-contact temperature detection elements 82, 83 output the first temperature information N2, N3, and the second and third IH control sections 23, 24 execute the warming-up control until the first temperature information N2, N3 reach the fixing temperature T1.

Thereafter, in the same manner as in steps S9 to S14, the non-contact temperature detection elements 82 to 85 output the first temperature information N2 to N5 and second temperature information M2 to M5. When it is judged that the difference temperature information G2 to G5 are within the second difference range GB, and the surface temperature of the heating roller 2 is uniform in the rotation direction, pass signals OK82 to OK85 are output.

Therefore, the heating roller 2 is controlled to be at the fixing temperature T1 in the axial direction or at a uniform temperature in the rotation direction.

Figure 7:
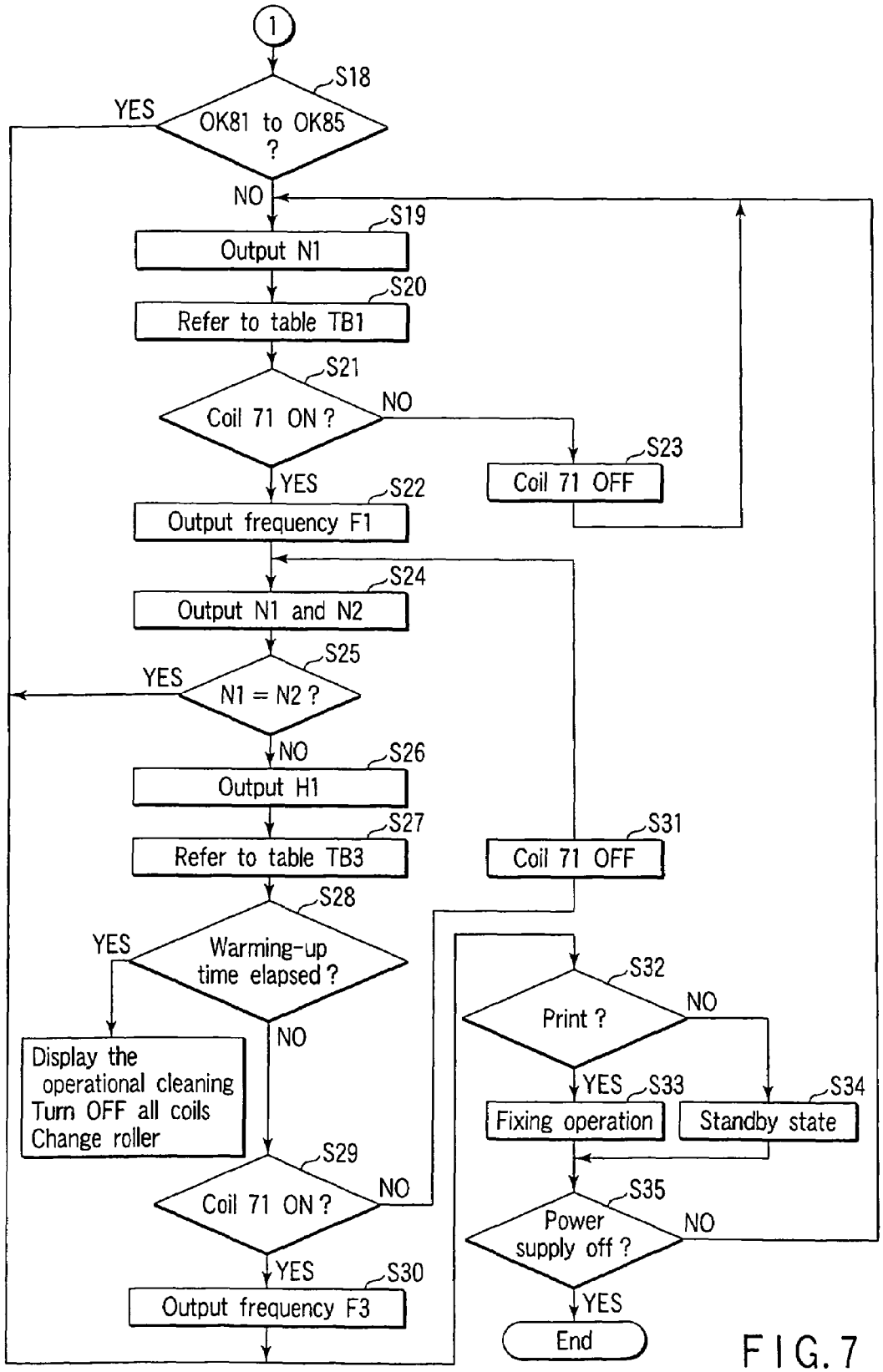
FIG. 7 is a flowchart showing continuation of the operation of the fixing apparatus shown in FIG. 6.

Next, the method of controlling the heating of the coil 71 for heating the middle portion of the heating roller 2 in the axial direction will be described with reference to FIG. 7 using continuation shown in FIG. 6.

The IH controller 21 judges whether or not the pass signals OK81 to OK85 are all output (S18). If not all the signals are output, the coil center mode is executed.

That is, the temperature detection circuit 26 outputs the first temperature information N1 detected by the first detection position 81A (S19). The first IH control section 22 refers to the table TB1 (S20), and judges whether or not there is output of the driving frequency F1 based on the first temperature information N1. If there is output of the driving frequency F1 (YES in S21), the driving frequency F1 is output as the driving signal SG1 of the coil 71 to the excitation circuit 25 (S22).

On the other hand, if there is no instruction for the output of the driving frequency F1 (NO in S21), it is judged that the surface temperature of the heating roller 2 is excessively higher than the fixing temperature T1, the power supplied to the coil 71 is stopped (S23), and the process returns to step S19.

Subsequently, the coil joint mode is executed. The non-contact temperature detection elements 81, 82 output the first temperature information N1, N2 to the IH controller 21 via the temperature detection circuit 26 (S24). If the first temperature information N1 is not equal to N2 (NO in S25), the IH controller 21 calculates the difference temperature information H1 (S26).

The first IH control section 22 refers to the table TB3 (S27). If the warming-up time W/UT has not elapsed (NO in S28), it is judged whether or not there is an output of the driving frequency F3 based on the difference temperature information H1 (S29). If there is output of the driving frequency F3 (YES in S29), the driving frequency F3 is output as the driving signal SG1 of the coil 71 to the excitation circuit 25 (S30).

On the other hand, if there is no instruction for the output of the driving frequency F3 (NO in S29), the power supplied to the coil 71 is stopped (S31), and the process returns to step S24).

If the power based on the driving frequency F3 is supplied to the coil 71 or if all the pass signals OK81 to OK85 are output in step S18 (YES in S18) or if the first temperature information N1 is equal to N2 in step S25 (YES in S25), it is judged whether or not there is a print instruction (fixing instruction) (S32). If there is a print instruction (YES in S32), the fixing operation is started (S33). If there is no print instruction (NO in S32), a standby mode is achieved (S34). If there is no instruction for power OFF (NO in S35), the process returns to step S19.

It is to be noted that in the present embodiment, the first temperature information N1 detected by the non-contact temperature detection element 81 and the first temperature information N2 detected by the non-contact temperature detection element 82 have been described. In the present invention, as described above, the temperature difference of the axial direction can be controlled to be minimum in a combination shown in FIGS. 4 and 5.

Therefore, the uniform temperature can be maintained in the axial direction even in the fixing operation in which the fixing sheet contacts a predetermined region of the heating roller 2.

As described above, the excitation circuit 25 is capable of outputting the excitation signals SG1 to SG3 which differ with each coil. Therefore, the power which is the heating force of the heating roller 2 can be quickly reset at the fixing temperature T1 based on the detected temperature information from the non-contact temperature, and the warming-up time can be shortened. The predetermined tables TB1 to TB4 are used, and the induction heating coil can be turned ON and OFF in accordance with the detected temperature information. Even when the coils are turned ON, the predetermined driving frequencies F1 to F4 are supplied. Therefore, a fluctuation of the heating roller 2 in the axial direction is suppressed, and the temperature can be controlled to be maintained at a certain temperature in the axial direction. Furthermore, even when heat is taken by the fixing sheet at a print operation time, the temperature information detected from the non-contact temperature detection elements in the vicinity are compared with each other, and the difference of the temperature in the axial direction can be minimized. Therefore, a defect in a main scanning line direction can be prevented from being caused in the image in the fixing sheet by high-temperature/low-temperature offset.

Moreover, at the warming-up time, the temperature in the axial direction rises at the fixing temperature while the heating roller 2 is rotated. The temperature control is executed based on the temperature information from the first and second detection positions A, B disposed in different phases in the rotation direction, and accordingly the temperature of the rotation direction can be made uniform. Accordingly, the temperature can be detected and regarded as the temperature of the nip portion used at the fixing time. Since the temperature difference in the rotation direction is minimized, a satisfactory fixed image is obtained even in a high-speed machine (copying machine, printer or the like which copies a large number of sheets in a minute).

Furthermore, in the present invention using the non-contact temperature detection mechanism, a certain slide contact trace can be prevented from being formed on the surface of the heating roller 2 by the temperature detection mechanism of a contact type, and the life of the heating roller 2 can be extended.

It is to be noted that in the present embodiment, five non-contact temperature detection elements have been described, but the present invention is not limited to this embodiment. For example, when the coils 72, 73 are electrically connected in series, and simultaneously controlled, at least the non-contact temperature detection elements 81, 82 may be disposed.

It is to be noted that the present embodiment relates to a constitution which applies the pressure to the heating roller from the pressurizing roller, but the present invention is not limited to this constitution, and the pressure may also be applied to the pressurizing roller from the heating roller.

What is claimed is:

1. A fixing apparatus comprising:

a heating roller which includes a conductive member;

a coil which is placed near the heating roller;

an excitation circuit which includes the coil;

a first control circuit which transmits a driving signal to the excitation circuit;

a plurality of temperature sensors which detects temperatures at two parts of the heating roller in a rotation direction thereof; and a second control circuit which compares outputs of the plurality of temperature sensors, wherein the second control circuit changes a control signal to be transmitted to the first control circuit in accordance with an output difference between the temperature sensors, wherein the second control circuit maintains first temperature difference information, and second temperature difference information whose value is lower than that of the first temperature difference information.

2. A fixing apparatus comprising:

heating roller which includes a conductive member;

a coil which is placed near the heating roller;

an excitation circuit which includes the coil;

a first control circuit which transmits a driving signal to the excitation circuit;

a plurality of temperature sensors which detects temperatures at two parts of the heating roller in a rotation direction thereof;

a control panel which displays warning information; and a second control circuit which compares outputs of the plurality of temperature sensors, wherein the second control circuit changes a control signal to be transmitted to the first control circuit in accordance with an output difference between the temperature sensors, and wherein the second control circuit displays the warning information on the control panel when the output difference exceeds a predetermined value.

3. The fixing apparatus according to claim 1, wherein the second control circuit stops the operation of the first control circuit when the value of the output difference is greater than the value of the first temperature difference information.

4. The fixing apparatus according to claim 3, wherein the first control circuit changes an output of the excitation circuit in accordance with a control signal transmitted from the second control circuit;

the second control circuit transmits the control signal to the first control circuit so that the excitation circuit is driven with a first output when the output difference falls within the range of the first and second temperature difference information, and with a second output when the output difference is below the second temperature difference information, respectively; and the first output is greater than the second output.

5. The fixing apparatus according to claim 1, wherein the heating roller includes:

a shaft;

an elastic layer which is provided around the shaft; and a conductive layer provided around the elastic layer, and wherein the coil is arranged outside the heating roller.

6. The fixing apparatus according to claim 5 further comprising:

a pressurizing roller which contacts the heating roller and rotates with the heating roller, wherein the plurality of the temperature sensors detect temperatures at a place upstream of the heating roller in the rotation direction thereof with reference to the position in which the heating roller is in contact with the pressurizing roller, the place being at the downstream side of the position at which the coil is arranged.

7. The fixing apparatus according to claim 6 further comprising a control panel which displays warning information, wherein the second control circuit displays the warning information on the control panel when the output difference exceeds a predetermined value.

8. The fixing apparatus according to claim 7, wherein the second control circuit maintains first temperature difference information, and second temperature difference information whose value is lower than that of the first temperature difference information.

9. The fixing apparatus according to claim 8, wherein the second control circuit stops the operation of the first control circuit when the value of the output difference is greater than the value of the first temperature difference information.

10. The fixing apparatus according to claim 9, wherein the first control circuit changes an output of the excitation circuit in accordance with a control signal transmitted from the second control circuit;

the second control circuit transmits the control signal to the first control circuit so that the excitation circuit is driven with a first output when the output difference falls within the range of the first and second temperature difference information, and with a second output when the output difference is below the second temperature difference information, respectively; and the first output is greater than the second output.

11. The fixing apparatus according to claim 1, wherein the plurality of temperature sensors are composed of one element.

* * * * *